US006486119B1

(12) United States Patent
Huntington et al.

(10) Patent No.: US 6,486,119 B1
(45) Date of Patent: Nov. 26, 2002

(54) RINSE-ADDED FABRIC CONDITIONING COMPOSITION BASED ON SPECIFIC STARCH AND METHOD USING SAME

(75) Inventors: Gregory Bruce Huntington, Overijse (BE); Kakumanu Pramod, West Chester, OH (US); Royal D. Collins, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/308,785

(22) PCT Filed: Nov. 26, 1997

(86) PCT No.: PCT/US97/21841

§ 371 (c)(1),
(2), (4) Date: May 25, 1999

(87) PCT Pub. No.: WO98/23715

PCT Pub. Date: Jun. 4, 1998

Related U.S. Application Data

(60) Provisional application No. 60/031,960, filed on Nov. 27, 1996.

(51) Int. Cl.[7] ..... C11D 3/26; C11D 3/20; C11D 3/22; B08B 3/04; D06M 15/11

(52) U.S. Cl. ..... 510/474; 510/521; 510/522; 134/29; 8/137; 427/439; 427/442

(58) Field of Search ..... 510/474, 521, 510/522; 134/29; 8/137; 427/439, 442

(56) References Cited

U.S. PATENT DOCUMENTS

| | | | | | |
|---|---|---|---|---|---|
| 2,702,755 | A | * | 2/1955 | Chaney | 106/213 |
| 2,826,506 | A | * | 3/1958 | Trusler | 106/208 |
| 4,011,169 | A | * | 3/1977 | Diehl et al. | 252/95 |
| 4,162,983 | A | * | 7/1979 | Johnson | 252/8.6 |
| 4,178,254 | A | * | 12/1979 | Leikhim et al. | 252/8.6 |
| 4,818,242 | A | * | 4/1989 | Burmeister et al. | 8/115.6 |
| 4,944,892 | A | * | 7/1990 | Leathers et al. | 252/92 |
| 2001/0046824 | A1 | * | 11/2001 | Nigam | 442/89 |

FOREIGN PATENT DOCUMENTS

| | | | | |
|---|---|---|---|---|
| WO | WO 98/23715 | * | 6/1998 | 510/474 |

* cited by examiner

*Primary Examiner*—Cynthia H. Kelly
*Assistant Examiner*—Dawn Garrett
(74) *Attorney, Agent, or Firm*—Jason J. Camp; Kim William Zerby; Steven W. Miller

(57) ABSTRACT

A rinse-added fabric conditioning composition comprising a starch having a gelatinization temperature of less than 150 degrees C. and a method of imparting crispness properties to fabrics treated with same.

8 Claims, No Drawings

RINSE-ADDED FABRIC CONDITIONING COMPOSITION BASED ON SPECIFIC STARCH AND METHOD USING SAME

This application claims the benefit of Provisional Application No. 60/031,960 filed Nov. 27, 1996.

TECHNICAL FIELD

This invention relates to compositions and methods for use during the rinse cycle of home laundering operations. The compositions are especially effective for providing crispness and soil release benefits to fabrics.

BACKGROUND ART

Modern fabric conditioning compositions, washing machines and dryers are subject to continuous improvement with a view to achieve a series of fabric benefits such as, for example, softening, body, anti-wrinkling, ease of ironing, and improvement in appearance.

One prevalent laundry attribute that consumers desire is that fabrics maintain their original crisp look and feel, particularly those items which are routinely ironed. Accordingly, it is an object of the present invention to provide a rinse-added fabric conditioning composition which impart crispness to fabrics rinsed therein. It has now been found that the above objective is met by a rinse-added fabric conditioning composition containing starch. According to the present invention, the starch added in the rinse deposits uniformly on the fabric. This starch can then impart crispness to the fabric, particularly after exposure to heat (e.g., steam ironing, tumble drying).

It has also been found that the starching film provides resistance of the fabric to subsequent soiling and allows subsequent soils to be more easily removed. The removal in the subsequent wash can be done by chemical means (e.g., hydrolysis, amylase digestion) or physical mean (e.g., solvation, simple physical desorption and separation from, the fabric).

Detergent compositions comprising starch are not new per se. Example is U.S. Pat. No. 3,892,681 describing substantially water-insoluble starch. The starch is characterised by a granular diameter of 0.1–45 microns and a swelling power of less than 15 at 65° C. improves the softness, the ease of ironing, the anti-static and anti-wrinkling performances. As of yet, however, no single fabric conditioning composition is available capable of providing textiles treated therewith in the conventional matter with the fabric-care benefits as referred to hereinabove.

SUMMARY OF THE INVENTION

The present invention provides rinse-added fabric conditioning compositions which are capable of imparting crispness and soil release benefits to the fabrics. These compositions comprise a specific starch having a gelatinization temperature of less than 150° C. In a preferred embodiment, the compositions further contain, in addition to the specific starch, a perfume.

In its method aspect, the present invention relates to a method for treating fabrics to simultaneously impart crispness and improved subsequent cleaning benefits.

DETAILED DESCRIPTION OF THE INVENTION

The rinse-added fabric conditioning compositions of the present invention comprise as an essential element a specific starch having a gelatinization temperature of less than 15020 C. The gelatinization temperature for gelatin is determined as setting point, several methods have been used to determine the setting point. Example is F. W. Wainwright, GGRA bull. 17(3), 10 (1966).

Although the final choice of starch which will meet requirements of this invention depends upon the origin of the material and also upon process conditions such as bleaching, degradation, and isolation applied to a given species, suitable starches can for example be selected from a. naturally occuring (e.g., corn, wheat, rice, tapioca, potatoes) or physically modified (e.g. small particle size such as rice starch or milled to promote smaller particle size and low temperature gelling; highly branched amylopectin content such as "waxy" starch grades; pre-gelatinized; acid treated).

b. chemically modified (e.g. hydroyxalkyl substituted ethers, tertiary and quaternary aminoalkyl starch phosphates, starch acetates).

Preferred starches are starch compounds that are easy to formulate into a solid or liquid product; readily disperse in the final rinse; can be co-delivered with other ingredients such as perfumes; do not promote any adverse effects on fabrics (e.g. yellowing); and are readily strippable in the following wash.

Examples of preferred soluble modified and/or natural starches are waxy starches with PO (hydroxy propyl) groups, quaternary amine groups, a combination of PO and quats, high molecular cross linked and modified starches. Commercially available starch derivatives of this class are: Gelex®, Polar gel® from American maize, Sta-lok® 180 and 374, Star-pol® 480 and 560 from Staley starch, Thermoflo®, National 1658 and Firm-tex from National starch.

The above mentioned benefit of crispness are obtained by the swelling and solvation of starch compounds at high temperature (50–75° C.), gelatinization. These mechanisms result in the forming of a hydrophilic film that binds to the cellulose fibers of the fabric. The hydrophilic film retains the hydrophilic character of the fabric and the water vapor perneability.

The benefit of improved soil release removal is a result of the hydrophilic film serving as a protective soil release barrier (e.g., soil repellant, soil absorbent or adsorbent, surface modifier to aid detergency, etc.). During a subsequent wash, these films would be at least partially removed by detergents.

The starch can be added in the rinse as a dry powder or can be formulated and admixed as a cold water dispersion.

EXAMPLES

Compositions

Two rinse-added fabric conditioning compositions (A/B) were prepared using Gelex® (A) and Polargel® (B). For each starch compound, a water dispersion was made (25 parts starch solids added to 75–175 parts water), heated to approximately 95+° C. with mixing to achieve a good dispersion, and then allowed to cool to ambient temperature.

Treatment

For each starch conditioning product, representative cotton and polycotton fabrics were washed in a standard home laundering washing machine using a heavy duty detergent composition and median wash conditions. Part of this bundle was a set of white, 100% cotton woven fabric tracers. The starch conditioner was introduced into the final rinse cycle. A sufficient amount was added to deliver 25 grams of starch solids to the laundry load. Following laundering, the tracer swatches were line-dried, steam ironed, and then stained with a broad assortment of real stain materials that are commonly used for standard detergent performance assessment. After allowing the stain materials to dry, the swatches were then relaundered, without applying the starch conditioner in the final rinse. After line drying, these TEST swatches were then compared vs. a corresponding set of CONTROL swatches for the relative degree of stain removal, as judged by expert graders. The CONTROL swatches were prepared in an identical fashion to the TEST swatches, except no starch conditioner was applied in the final rinse during the first "pre-staining" laundering cycle.

Results

Positive and statistically significant (95% confidence level) stain removal benefits were observed for both starch materials across a broad spectrum of realistic stains. Results are expressed using the standard Panel Score Unit scale: +4 psu (very large difference in favor of TEST product) to −4 psu (very large difference in favor of CONTROL product).

| Gelex ® Treatment A | | Polargel ® Treatment B | |
|---|---|---|---|
| Stain | Results | Stain | Results |
| cooked butter | +1.8 s | cooked butter | +2.3 s |
| curry blend sauce | +1.2 s | dirty motor oil | +2.6 s |
| wine | +2.1 s | lipstick | +1.2 s |
| red currant | +0.6 s | ketchup | +1.7 s |
| chocolate pudding | +2.4 s | wine | +1.0 s |
| milk chocolate | +1.7 s | milk chocolate | +1.2 s |
| grass | +0.6 s | clay - type A | +1.4 s |
| clay - type A | +2.5 s | clay - type B | +0.8 s |
| clay - type B | +2.2 s | | |
| clay - type C | +1.4 s | | |
| clay - type D | +2.4 s | | |

In addition to the above soil release benefits, it was also observed that a starch conditioning treatment delivered in the claimed manner (final rinse) could impart a noticeably different and more crisp feel versus the nonconditioned swatches.

What is claimed is:

1. A method for treating fabric to simultaneously impart crispness and improved soil release properties to the fabric, comprising contacting said fabric in a rinse cycle with a film-forming aqueous solution comprising a crispness-imparting, soil release-improving agent consisting essentially of a waxy starch having a gelatinization temperature of less than about 150° C., and containing hydroxy propyl groups, quaternary ammonium groups, or a mixture thereof.

2. The method of claim 1, wherein the film-forming aqueous solution comprises the crispness-imparting, soil release-improving agent in an amount of 25 parts per 75–175 parts water.

3. The method of claim 1, wherein the film-forming aqueous solution further comprises perfume.

4. The method of claim 1, wherein the fabric is cotton.

5. The method of claim 1, wherein the fabric is polycotton.

6. The method of claim 1, further comprising exposing the fabric to heat after the contact.

7. The method of claim 6, wherein the heat exposure comprises ironing.

8. The method of claim 6, wherein heat exposure comprises tumble drying.

* * * * *